United States Patent [19]

Autelli

[11] 4,135,534

[45] Jan. 23, 1979

[54] MULTI-NOZZLE MULTIPLE LANCE FOR WASHING ROTATING HEAT EXCHANGERS AND A DISTRIBUTOR FOR SAID LANCE

[76] Inventor: Giulio Autelli, via Giordano Bruno 18/9, Genoa, Italy

[21] Appl. No.: 820,687

[22] Filed: Aug. 1, 1977

[30] Foreign Application Priority Data

Dec. 23, 1976 [IT] Italy ..... 12947 A/76

[51] Int. Cl.[2] ..... B08B 3/02; B08B 9/00

[52] U.S. Cl. ..... 134/170; 165/5; 165/95

[58] Field of Search ..... 134/96–98, 134/152–153, 166 R, 169 R, 166 C–169 C, 170–171; 165/5, 95

[56] References Cited

U.S. PATENT DOCUMENTS

| | | | |
|---|---|---|---|
| 2,169,620 | 8/1939 | Spayd | 134/98 |
| 3,643,344 | 2/1972 | Strube | 165/89 X |

FOREIGN PATENT DOCUMENTS

| | | | |
|---|---|---|---|
| 186064 | 10/1922 | United Kingdom | 165/5 |

*Primary Examiner*—Robert L. Bleutge

*Attorney, Agent, or Firm*—Robert E. Burns; Emmanuel J. Lobato; Bruce L. Adams

[57] ABSTRACT

A system of lances for washing a rotating heat exchanger. The lances extend from a cylindrical manifold wherein a hollow cylinder is rotatably mounted to distribute a washing fluid successively to the different lances, and thereby to different annular areas of the rotating heat exchanger.

5 Claims, 6 Drawing Figures

A
II
12A
11
12
4
7
13
10
3
14
9
6
2
1
5
20
8

A
12
11
7
10
6
III
I 30
20
33
32
8
31
34
5
7
6
21
24
38
21B
21A
21C
23
22
37
36
35
IV
V
VI

MULTI-NOZZLE MULTIPLE LANCE FOR WASHING ROTATING HEAT EXCHANGERS AND A DISTRIBUTOR FOR SAID LANCE

BACKGROUND OF THE INVENTION

The invention serves for the washing of heat exchangers, including for example air pre-heaters of the type Ljungstrom or Nowden, which consist of a rotating drum formed by crowns of heat exchanging sheets which, by passing alternatively through the burnt gas discharged and the combustion air newly fed, give to said air the heat previously removed from said burnt gases.

It is known that the sheet pack distributed in annular crowns must be periodically cleaned by both blowing with steam, compressed air, and washing with water. To this end it is known to use stationary or removable lances allowing said cleaning. Said lances comprise a plurality of nozzles directed downwards in order to direct the cleaning fluid used into the spaces existing between the sheets said heat exchanger consists of. The known lances of this kind have however some inconveniences:

(a) as said lances generally have a constant section, obviously a pressure gradient occurs from the root to the end of the lance, consequently the fluid jet coming from the nozzles arranged near the exchanger periphery are more efficient;

(b) as the surface to be cleaned is larger in the periphery than near the exchanger center, a time of cleaning proportional to the area of the outermost crown of the exchanger must be used.

On the other hand, it is not possible to make a conduit with a section decreasing from the periphery towards the center of said exchanger, as its size and cost would be excessive; nor to arrange on a single lance the nozzles in the radial direction of the exchanger, as that too would require an excessive size and cost.

SUMMARY OF THE INVENTION

The invention has for its object to remove said disadvantages through a multiple lance having the axial size, with respect to the exchanger, of a single lance, and with a still limited cost, being formed by cylindric pipes.

Further, by providing each lance with a set of nozzles concentrated in a specific annular crown of said exchanger, different annular crowns of the exchanger may be cleaned successively, exploiting at the maximum the availability of pressure and delivery of the cleaning fluid and selecting each time the most suitable cleaning time, that is proportional to the area of the crown concerned.

The invention is completed by a suitable automatic distributor feeding, one after the other, the various lances.

BRIEF DESCRIPTION OF THE DRAWINGS

In order that the invention may be clearly understood, it will now be described, by way of example, with reference to the accompanying drawings, wherein.

DESCRIPTION OF A PREFERRED EMBODIMENT

Figure 1:
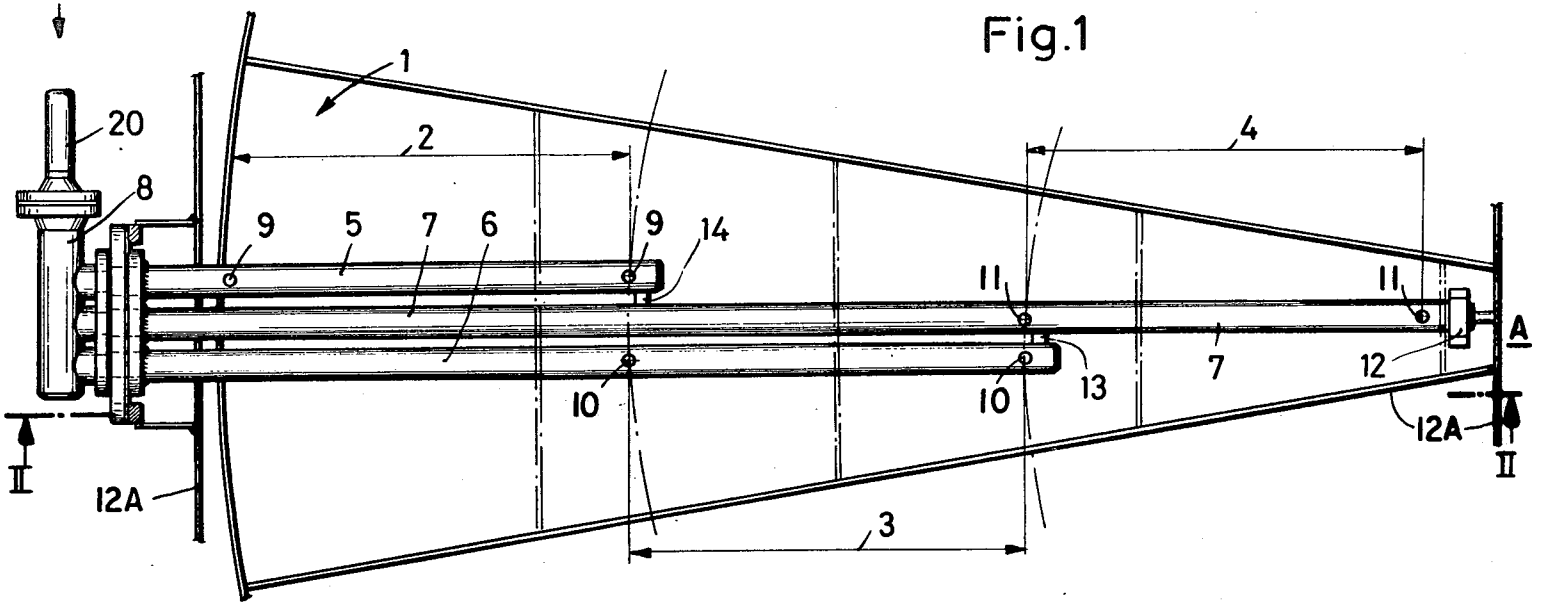
FIG. 1 shows a plan view of the invention in a preferred embodiment.
Figure 2:
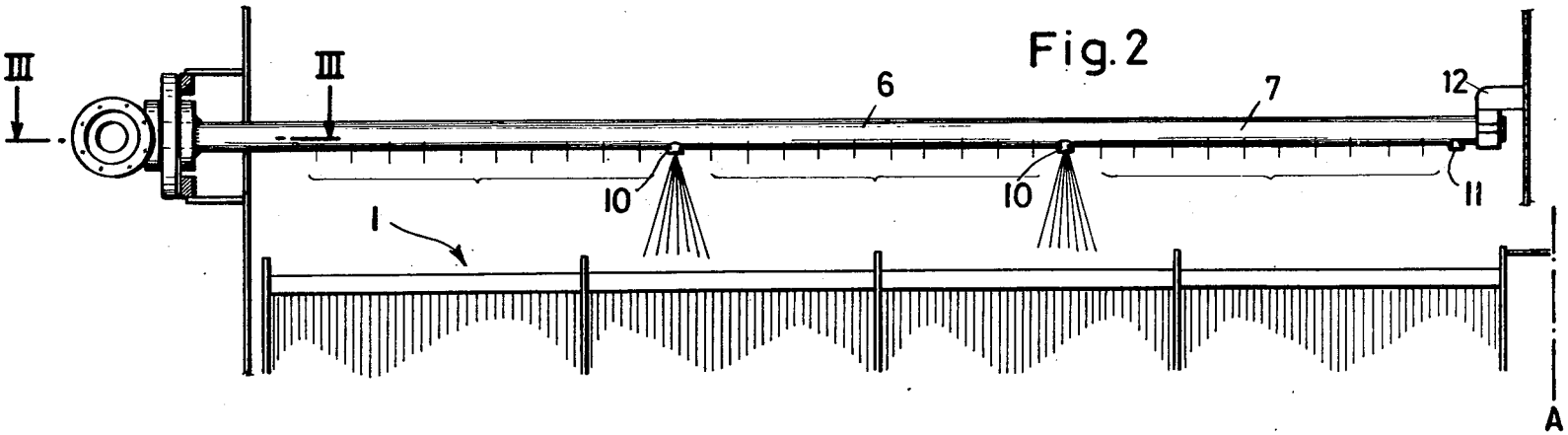
FIG. 2 shows a section long II—II of FIG. 1.

With particular reference to FIGS. 1 and 2, there is provided a drum-shaped heat exchanger 1 of known type, rotatable about its axis A. Numerals 2, 3, 4 denote the widths of three concentric circular crowns or sheet packs 1*a*, into which the exchanger is coaxially divided. Over these three annular zones, three lances 5, 6, 7 are provided, parallel and adjacent to one another, the first of which extends from the periphery of drum 1 to the inner edge of zone 2; the second extends to the inner edge of zone 3, while the third extends to the inner edge of zone 4 which is the innermost of them all.

Said three lances 5, 6, 7 end, at their root, into a single manifold 8 disposed on side drum 1 and described in detail herebelow. Each of said three lances has a set of nozzles arranged near each other axially spaced to the corresponding sets of the other lances, and directed towards said exchanger 1, and denoted by numerals 9, 10, 11. It is to be noted that said nozzles 9 are arranged on lance 5 which is the shortest, and thus are in position to direct a series of fluid jets onto the outermost annular crown 2. Said nozzles 10 are arranged on lance 6 only correspondingly to the annular zone 3 and not along the whole length of said lance; said nozzles 11 are arranged on lance 7 only correspondingly to the innermost zone 4 and not along the whole length of said lance.

Said manifold 8 is provided with a distributor, described herebelow, in position to feed a lance at a time.

Therefore, when lance 5 is fed, the cleaning fluid is directed only onto said annular zone 2; the same happens when lance 6 is fed, with respect to said annular zone 3.

Obviously, said cleaning fluid may consist, according to the heat exchanger's requirements, of compressed air, steam or water.

In order to give said three lances a sufficient strength, the longest may be supported at its inner end by a support bracket 12, secured to a frame 12'. The inner end of said lance 6 may rest against said lance 7, and similarly for lance 5, through bars 13, 14.

Figures 3, 4, 5, 6:
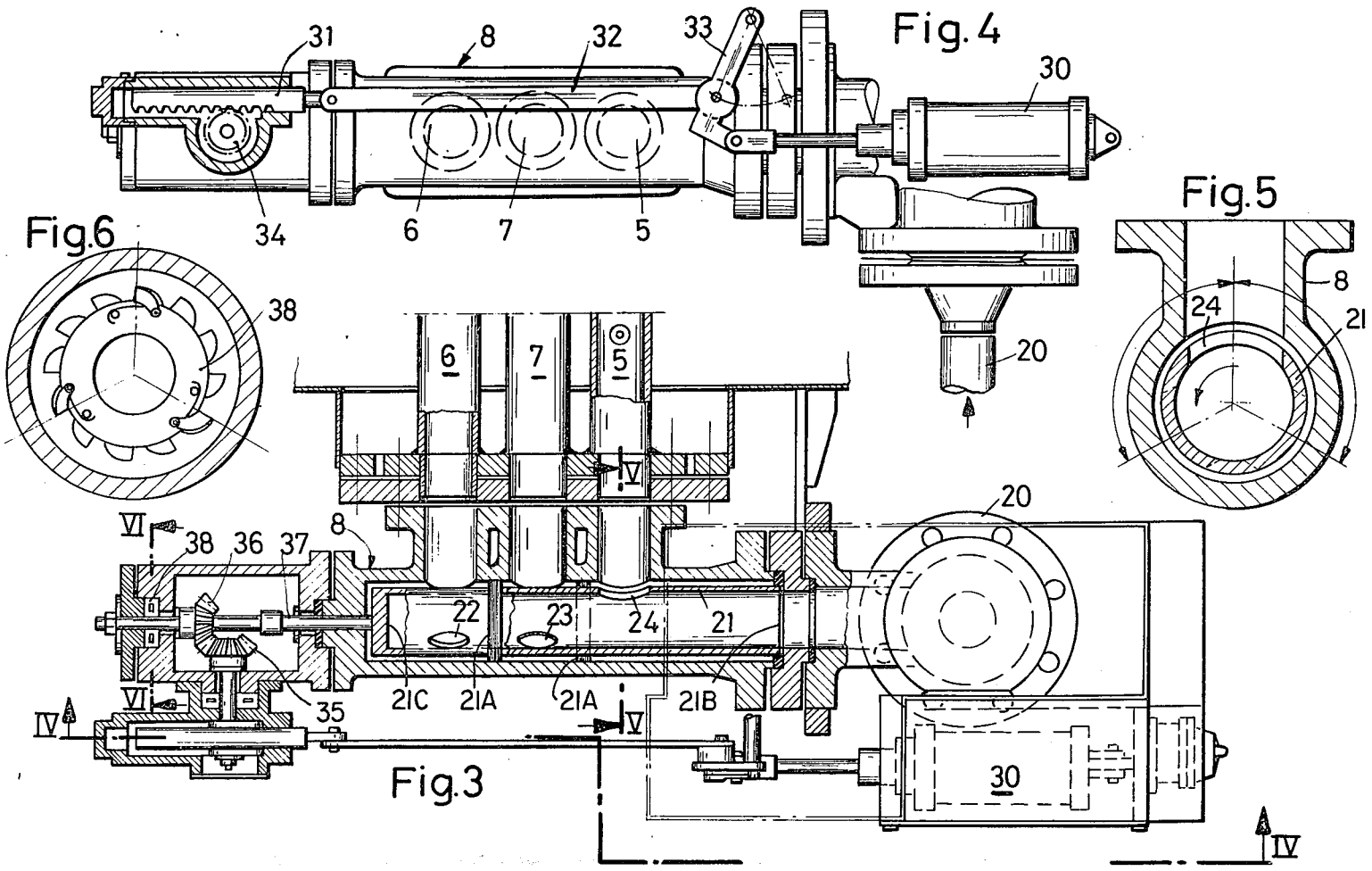
FIG. 3 shows, in a section along line III—III of FIG. 2 the distributor feeding the various lances in succession.
FIG. 4 shows a view, partly in section, of the distributor shown in FIG. 3, along line IV—IV of said FIG. 3.
FIG. 5 shows a section along line V—V of FIG. 3.
FIG. 6 shows a section along line VI—VI of FIG. 3.

FIGS. 3 and 4 show how, according to the invention, is embodied said distributor which, through said manifold 8, feeds the cleaning fluid coming from a conduit 20, alternatively to said three lances 5, 6, 7.

Said distributor consists substantially of a hollow cylinder 21 having an outer diameter substantially equal to the inner diameter of said manifold 8; said cylinder acting through suitable guide rings, 21A, to seal passages to the lances from one another, and being free to rotate inside said manifold 8. Said cylinder 21 has one end 21B open so as to be able to receive the cleaning fluid from the feeding conduit 20.

Said distributor 21 is further provided, on its side, with three bores 22, 23, 24 spaced axially so as to have their centers opposite the axes of said lances 5, 6, 7.

Besides, said bores are staggered circumferentially and have their centers, as shown in FIG. 5, on radial planes staggered by 120° with respect to one another.

In such a way, there are three positions of the cited distributor with respect to said manifold 8, allowing to feed a lance at the time: by rotating piston 21 by 120° and then by 240°, said conduit 20 feeds the cleaning fluid to lances 5, 6, 7 respectively through the corresponding openings 22, 23, 24.

Up to now, the respective derivation portions of the lances from said manifold 8 have been denoted by the same numerals denoting the lances.

According to a preferred embodiment of the invention, with particular reference to FIGS. 3 and 6, the rotation motion of said distributor 21 is performed by means of a double-effect piston jack 30. The piston provides a rack 31, through a suitable system of levers 32 and 33, with a reciprocating movement.

Said rack 31 engages a pinion 34 integral with, in rotation, a conical pinion 35 whose axis is perpendicular to the axis of said distributor 21.

Said conical wheel engages on its turn a second conical wheel 36, coaxial to said distributor 21 and freely turnable on a shaft 37 fixedly fastened to a bottom 21C of said distributor 21.

Said conical wheel 36 is coupled in rotation to a shaft 37 through single-directioned joint, e.g. of the kind known as free trip catch or one-way transmission, denoted by numeral 38 in the drawings and able to transmit the rotation motion of said wheel 36 to said shaft 37, only for leftward movements od said rack 31.

The length of the rack, and thus the stroke of the piston of said jack 30, will be such as to correspond to a rotation of 120° of said distributor 21, obviously considering the number of teeth of said wheels 34, 35, 36, as well as the number of teeth of said rack.

In such a way, the piston mechanism puts successively in communication the openings 22, 23, 24 of said distributor 21 with the individual lances 5, 6, 7. The quick return movement of said rack 31 will allow to repeat the cycle.

It is to be understood that the invention is not limited to the example shown. It is intended to cover all modifications and equivalents within the scope of the appended claims.

What I claim is:

1. A lance system for cleaning a rotary drum heat exchanger, comprising;

a plurality of hollow lances disposed side by side;

means for stationarily mounting the lances so that they extend radially over an end of a rotary heat exchanger drum consisting of sheet packs coaxial with the drum's axis of rotation;

a set of nozzles on each lance, axially spaced from the sets of nozzles on the other lances, for discharging a washing fluid into a corresponding one of the sheet packs;

a cylindrical supply manifold common to and communicating with the lances at axially spaced apart points of the manifold, the manifold being disposed outside the drum;

a cylindrical distributor rotatably mounted in the manifold for cyclically supplying the washing fluid to the lances; and means for rotating the distributor for the cyclic supplying of the washing fluid.

2. A lance system according to claim 1 in which the hollow lances are disposed parallel and adjacent to one another, and have bracket and frame means for supporting them remotely of the supply manifold.

3. A lance system according to claim 1, wherein the distributor has an open end for receiving the cleaning fluid, and has a plurality of axially spaced apertures on its side, staggered to communicate cyclically with the lances upon the rotating of the distributor.

4. A lance system according to claim 1, wherein the means for rotating the distributor comprises a double-action jack mechanism which in turn comprises a piston, a rack longitudinally movable therewith, a pinion rotated by the rack, a first conical gear rotatable by the pinion, a second conical gear coaxial to the distributor and rotatable by the first conical gear for effecting the rotating of the distributor, and means for reciprocating the piston in the jack mechanism.

5. A lance system according to claim 4, including a one-way transmission interposed between the second gear and the distributor, for effecting single-directioned rotation of the distributor by the double-action jack mechanism.

* * * * *